US008905537B2

(12) United States Patent
Lo et al.

(10) Patent No.: US 8,905,537 B2
(45) Date of Patent: Dec. 9, 2014

(54) MEDIA HANDLING DEVICE INCLUDING A CARRIER STRUCTURE FOR A SET OF STARWHEELS

(75) Inventors: Kevin Lo, Vancouver, WA (US); David Whalen, Vancouver, WA (US); John Engel, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 150 days.

(21) Appl. No.: 13/483,927

(22) Filed: May 30, 2012

(65) Prior Publication Data

US 2013/0321546 A1 Dec. 5, 2013

(51) Int. Cl.
*B41J 2/01* (2006.01)

(52) U.S. Cl.
USPC ..... 347/104

(58) Field of Classification Search
None
See application file for complete search history.

(56) References Cited

U.S. PATENT DOCUMENTS 5,420,621 A * 5/1995 Richtsmeier et al. ..... 347/104
5,580,042 A 12/1996 Taniguro et al.
6,206,500 B1 3/2001 Hirano et al.
6,334,565 B1 1/2002 Berrigan
6,386,536 B1 5/2002 Juan
7,223,033 B2 5/2007 Huang et al.
2006/0285909 A1 12/2006 Peck et al.

FOREIGN PATENT DOCUMENTS

EP 0622226 A2 11/1994
JP 2006326918 A * 12/2006

OTHER PUBLICATIONS

Machine Translation of JP 2006326918 A, Entire Document, Figs. 1-8.*

* cited by examiner

*Primary Examiner* — Lisa M Solomon

(57) ABSTRACT

A media handling device for a printer is provided. The media handling device includes a base structure and an assembly provided on the base structure. The assembly comprises a carrier structure that has a first end that is coupled to the base structure. The carrier structure is coupled to the base structure to move inwards from an original position and is under bias to return to the original position, in order to receive a media sheet during a print operation. The assembly also comprises a set of starwheels provided with the carrier structure. Each starwheel rotates while contacting the media sheet during the print operation.

18 Claims, 6 Drawing Sheets

MEDIA HANDLING DEVICE INCLUDING A CARRIER STRUCTURE FOR A SET OF STARWHEELS

BACKGROUND

A variety of different types of printers, such as inkjet printers and laser printers, includes mechanisms to move media (e.g., paper) through a printer. For a printer to work efficiently, the mechanisms must help move paper from the input tray through the output tray during a print operation, for example, without having paper get jammed within the printer.

BRIEF DESCRIPTION OF THE DRAWINGS

The disclosure herein is illustrated by way of example, and not by way of limitation, in the figures of the accompanying drawings and in which like reference numerals refer to similar elements, and in which.

DETAILED DESCRIPTION

Figure 1A:
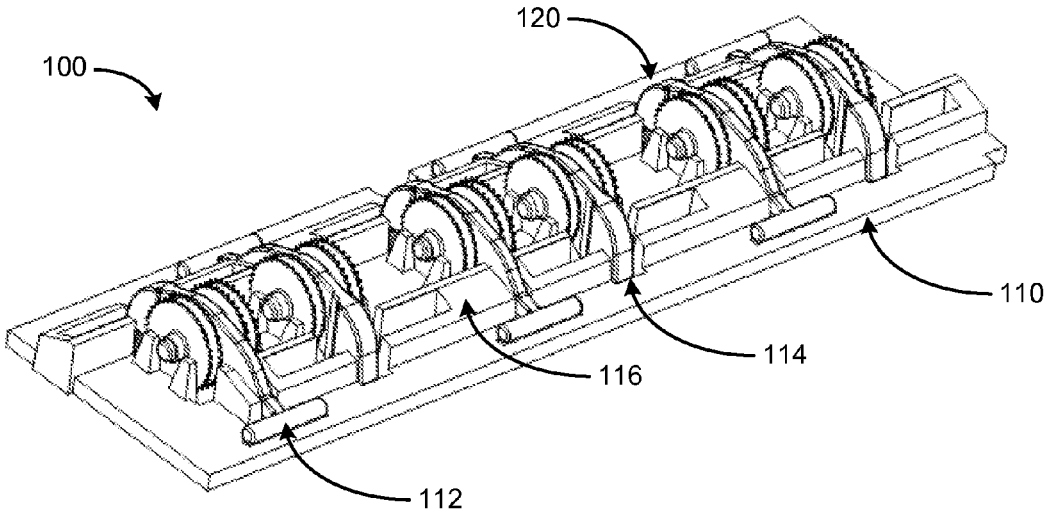
FIG. 1A-1C illustrate an example assembly for a media handling device, under an embodiment.

Embodiments described herein provide for a media handling device of a printer, having a carrier structure that biases inward to receive a media sheet (e.g., paper) during a print operation, while using starwheels that engage the media sheet and cause the media sheet to feed into the media handling device.

Depending on implementation variations, the media handling device can be provided within different parts of the printer (e.g., near the input tray, and/or near the output tray). Additionally, the media handling device can work in conjunction with other mechanisms of the printer (e.g., with a roller) to provide sufficient force, without puncturing or damaging the media, to help move media through the printer.

In one embodiment, the media handling device is provided adjacent to a roller device, such as a rubber roller that is provided with a drive shaft. During a print operation, a media sheet can be pushed or pulled between the roller and the media handling device so that the media sheet can be properly moved through the printer along a media route (e.g., from the input tray to the output tray). The assembly of the media handling device can provide sufficient force on the media sheet against the roller (e.g., as a result of the set of starwheels making contact with the media sheet) so that the media sheet does not slip out or get jammed within the printer during the print operation.

In some embodiments, the media handling device includes a base structure and an assembly that is provided on the base structure. The assembly includes a carrier structure and a set of starwheels. The carrier structure has a first end and a second end, with the first end being coupled to the base structure to move inwards from an original position. The carrier structure is under bias to return to the original position, in order to receive a media sheet during a print operation performed by a printer. The set of starwheels are provided with the carrier structure so that each starwheel is rotates while making contact with the media sheet during the print operation. In one embodiment, the media handling device can include a plurality of assemblies (e.g., four or eight) that are aligned with one another on the base structure.

In one embodiment, the assembly can have an equal number of starwheels that are provided on opposite sides of the carrier structure. For example, three starwheels can be provided on each side of the carrier structure. An equal number of starwheels can provide a proper balance for the carrier structure in the assembly.

According to some embodiments, the assembly can be coupled to the base structure so that the first end of the carrier structure can be coupled to a pivot point of the base structure. The second end of the carrier structure can be engaged with a spring that is coupled to the base structure to enable the carrier structure to move partially inward (e.g., toward the base structure) when a sheet of paper is received by the media handling device during a print operation.

As used herein, the term "substantially" means at least 90% of a stated reference, value or point of comparison. In the context of "substantially aligned," for example, two objects that are substantially aligned may be positioned so as to be aligned within 90% of each other.

System Description

Figure 1B:
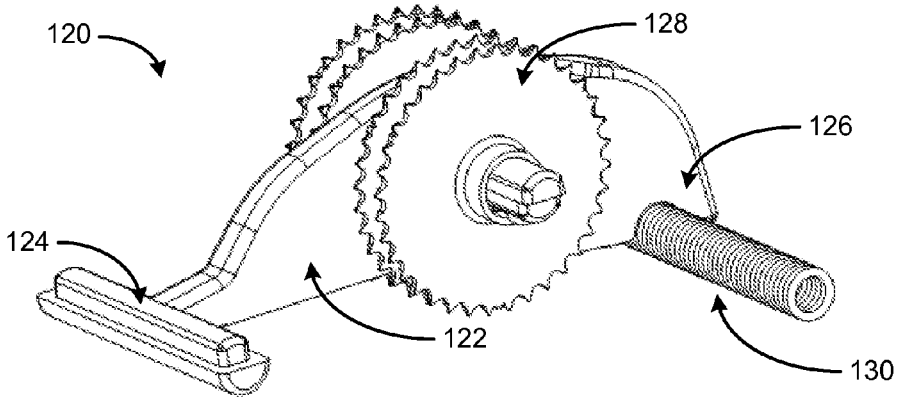
Figure 1C:
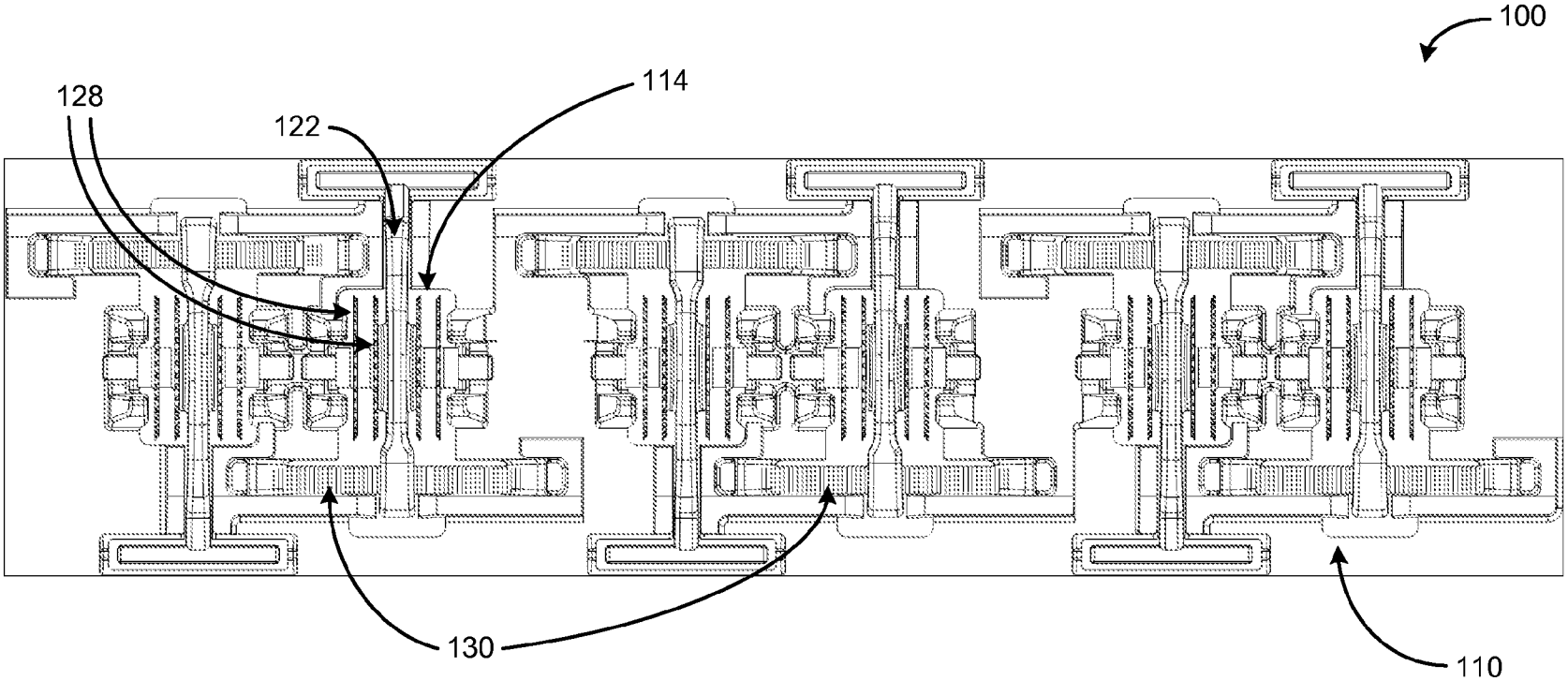

FIGS. 1A-1C illustrate an example media handling device, under an embodiment. A device such as described with respect to FIGS. 1A-1C can be provided on, for example, a printer, such as an impact printer or a non-impact printer (e.g., an inkjet printer or a laser printer). A media handling device 100 can work in conjunction with other mechanisms of a printer (e.g., with a roller device) to provide sufficient pinch force on the media to help move media (e.g., a sheet of paper) through the printer without puncturing or damaging the media.

According to an embodiment, the media handling device 100 includes a base structure 110 and at least one assembly 120 provided on the base structure 110. In some embodiments, the media handling device 100 can include a plurality of assemblies 120 provided on the base structure. For example, as depicted in FIG. 1A and FIG. 1C (e.g., a top view of FIG. 1A), the media handling device 100 can include six assemblies 120 that are substantially aligned with each other on the base structure 110. The base structure 110 of the media handling device 100 can be provided on or with different parts within a printer in order to assist the movement of media along a media route within the printer.

In one embodiment, the base structure 110 can include one or more pivot points 112, one or more slots 114, and/or one or more raised features 116 to enable the assembly 120 to be properly positioned on the base structure 110. For example, each assembly 120 that is provided on the base structure 110 can be coupled to the base structure 110 at a pivot point 112 and be positioned within a slot 114. This enables the assembly 120 to be able to move or rotate partially inwards (e.g., within the slot 114 of the base structure 110) when force, due to the media sheet(s), for example, is applied down on the assembly 120 towards the base structure 110.

The media handling device 100 also includes one or more assemblies 120 that each includes a carrier structure 122 having a first end 124 and a second end 126. Each assembly 120 also includes a set of starwheels (e.g., one or more starwheels) 128 that can be coupled to either side of the carrier structure 122. A starwheel 128, as described in this application, is a wheel that includes a plurality of teeth or extended points around its circumference and is capable of rotating about its center.

In some embodiments, for example, the plurality of teeth around the circumference of a starwheel 128 can make contact with a media sheet and rotate about its center when the media sheet is received by the media handling device 100 during a print operation. The plurality teeth can provide friction or traction for helping move media through the printer. In one embodiment, the set of starwheels 128 for an assembly 120 can be coupled to the carrier structure 122 via a pair of pins that extend out from the body of the carrier structure 122 (e.g., each pin can extend out near the middle of the body of the carrier structure 122). As illustrated in FIG. 1B, for example, the assembly 120 can include a total of four individual starwheels 128 with two starwheels being coupled to each side of the carrier structure 122. The assembly 120 can be better balanced by having an equal number of starwheels 128 on each side of the carrier structure 122. In other embodiments, the carrier structure 122 can have a different number of starwheels 128 on each side of the carrier structure 122 (e.g., zero on one side, one on the other side; two on one side, three on the other side, etc.).

In various embodiments, a starwheel 128 on one side of the carrier structure 122 can also be independent from other starwheels 128 on the same side of the carrier structure 122 (e.g., one starwheel can freely rotate independently from the other starwheels), or can be coupled to one or more other starwheels 128 so that they rotate in unison.

The assembly 120 can be positioned on the base structure 110 so that the first end 124 of the carrier structure 122 is coupled to the base structure 110 via a pivot point 112. The first end 124 can include a mechanism to couple to the pivot point 112 of the base structure 110 so that the carrier structure 122 can partially move or rotate about the pivot point 112 (e.g., a hinge or other mechanism to provide an angle of rotation). As depicted in FIG. 1B, for example, the carrier structure 122 can have a T-shaped form so that the first end 124 has an elongated portion (that is perpendicular to the body of the carrier structure 122) that can couple to the pivot point 112 of the base structure 110.

The assembly 120 can also be positioned on the base structure 110 so that the second end 126 of the carrier structure 122 is engaged with a spring 130. The spring 130 can bias the assembly 120 to be in an original position. The spring 130 can be one or more of a variety of different spring mechanisms (e.g., an axle spring, a coil spring, a flat spring, a compression spring, a tension spring). In some embodiments, the second end 126 of the carrier structure 122 can be free standing (e.g., disconnected) from the spring 130 so that it rests on top of the spring 130. For example, the spring 130 can be an axle spring that is positioned within a groove (e.g., a groove within the raised features 116) of the base structure 110. The second end 126 of the carrier structure 122 can engage with the spring 130 so that when force is applied down on the assembly toward the base, the spring 130 can flex inwards towards the base structure 110 and enable the carrier structure 122 to partially move or rotate inwards as well.

According to some embodiments, the media handling device 130 can include a plurality of assemblies 120. The assemblies 120 can be arranged on the base structure 110 so that each assembly 120 is substantially aligned with each other. For example, as illustrated in FIG. 1C, the media handling device 130 can include six assemblies 120, where the set of starwheels 128 for each of the assemblies 120 are substantially aligned with each other (e.g., the pins of one assembly is substantially aligned with the pins of the other assemblies). In other embodiments, the assemblies 120 can be aligned and simultaneously arranged in an inverted arrangement.

For example, the inverted arrangement of the assemblies 120 can be seen in the example provided in FIG. 1C. The six assemblies 120 are substantially aligned with each other, but at the same time, each assembly 120 is inverted with respect to each of the adjacent assemblies 120. In some embodiments, such as when the carrier structure 122 is in a T-shaped form, the assemblies 120 can be nested with each other, while enabling each of the assemblies 120 to be independent from each other. The inverted arrangement of the assemblies 120 can enable a higher number of assemblies 120 to be provided on the base structure 110 (e.g., higher density of assemblies 120 can exist on the same size base structure 110).

According to some embodiments, the assemblies 120 are positioned on the base structure 110 so that the maximum height of each of the assemblies 120 (e.g., the highest point of the starwheel 128) relative to the base structure 110 is substantially the same across all of the assemblies 120. This enables each of the starwheels 128 of the assemblies 120 to evenly make contact with a media sheet when the media sheet is received by the media handling device 110 during a print operation.

The arrangement of the carrier structure 122 with the spring 130 can provide a lever moment with a force due to the spring 130. By distributing a plurality of assemblies 120 on the media handling device 100, each of the starwheels 128 can provide a pinching force (a force applied by the starwheel 128 to hold the media against the opposing roller device) on a media sheet. In this manner, the amount of pinching force that is applied by the starwheels 128 on the media sheet to the roller device can be better evenly distributed across the entire media sheet. This prevents the media handling device 100 from damaging (e.g., create tracking marks or indents) or puncturing the media. In addition, by spreading out or distributing the assemblies 120 along the media handling device 100, a better distribution of force can be provided on the media sheet to prevent the media from shifting out of alignment along the media route, slipping, stalling, or jamming within the printer.

For example, the media handling device 100 can be positioned within a printer so that the starwheels 128 of the one or more assemblies 120 can be in contact with a roller device (e.g., a rubber roller). The roller can rotate during a print operation of the printer to cause a sheet(s) of media to be moved through the printer along a media route within the printer (e.g., the route from the input tray where the blank media sheets originally reside to the output tray after the print operation has completed). When the printer is not performing a print operation and no media is being moved through the printer (e.g., the printer is at a resting or standby state), the starwheels 128 of the assembly 120 can remain stagnant and remain in contact with the roller.

However, during a print operation when a media sheet is being moved between the roller and the media handling device 100, the starwheels 128 can make contact with the media sheet (e.g., pinch the media sheet against the roller), rotate about its center, and assist in properly moving the media sheet through the media route. A distribution of starwheels 128 on the media handling device 100 can provide for sufficient pinching force to move the media sheet through the media route without puncturing or damaging the media. The amount of pinching force by the media handling device 100 can be increased by providing a higher number of assemblies 120 on the media handling device 100 and/or by increasing the number of starwheels 128.

The plurality of starwheels 128 can also be arranged on the base structure 110 to enable the media handling device 100 to receive and assist in moving different sizes of media in the printer. In one embodiment, six assemblies 120 can be substantially aligned and spaced out on the base structure 110 so that the two starwheels 128 furthest from each other can span at least three inches (e.g., so that the media handling device 100 can receive a 3 inch×5 inch index card media and any other media having sizes larger). Similarly, in another embodiment, seven assemblies 120 can be substantially aligned so that the two starwheels 128 furthest from each other can span at least four inches (e.g., so that the media handling device 100 can receive a 4 inch×6 inch index card media and any other media having sizes larger). Different numbers of assemblies 120 can also be provided on the base structure 110 (e.g., twelve assemblies spanning eight inches or more).

Figure 2:
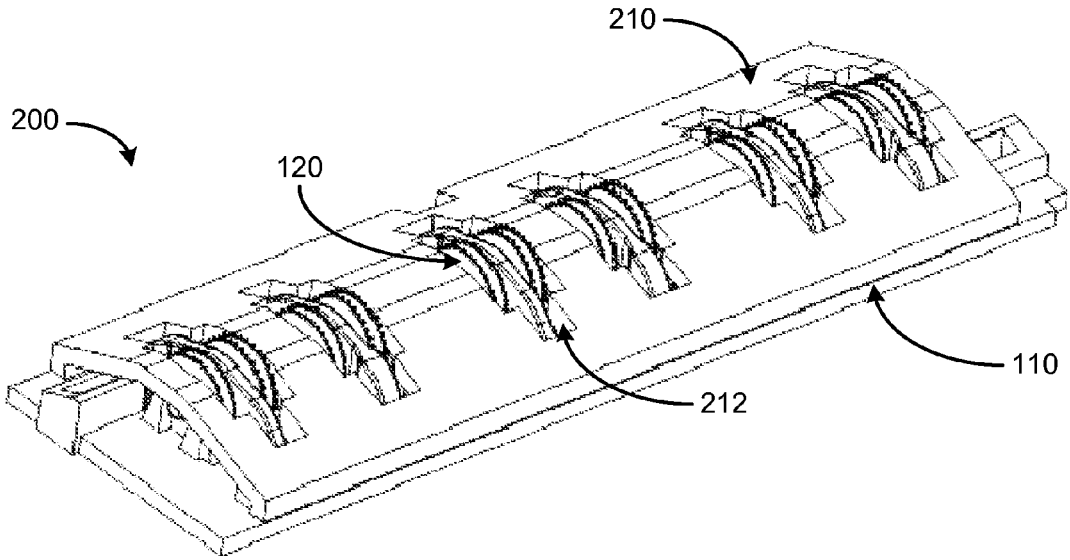
FIG. 2 illustrates an example media handling device for a printer, under another embodiment.

FIG. 2 illustrates an example media handling device for a printer, under another embodiment. A media handling device 200 can be similar to the media handling device 100 as described in FIGS. 1A-1B. The media handling device 200 can include a base structure 110, and one or more assemblies 120. The media handling device 200 can also include an upper layer structure 210 that can engage with the base structure 110 and/or one or more assemblies 120.

According to an embodiment, the upper layer structure 210 can include one more slots 212 that substantially align with the one or more assemblies 120, so that a portion of the assemblies 120 can protrude through the one or more slots 212, respectively. In this manner, when a media sheet is received by the media handling device 200 during a print operation by the printer (e.g., when the media sheet is being moved along the media route within the printer), the media sheet can be in contact with the teeth of the plurality of starwheels that protrude through the one or more slots 212 (e.g., the media sheet can be pinched by the starwheels against a roller).

The upper layer structure 210 can combine with the base structure 110 to provide a frame that holds the assemblies 120 in place. In some embodiments, the upper layer structure 210 can also have a curved shape to prevent media from being obstructed when it is received by the media handling device 200.

Figure 3:
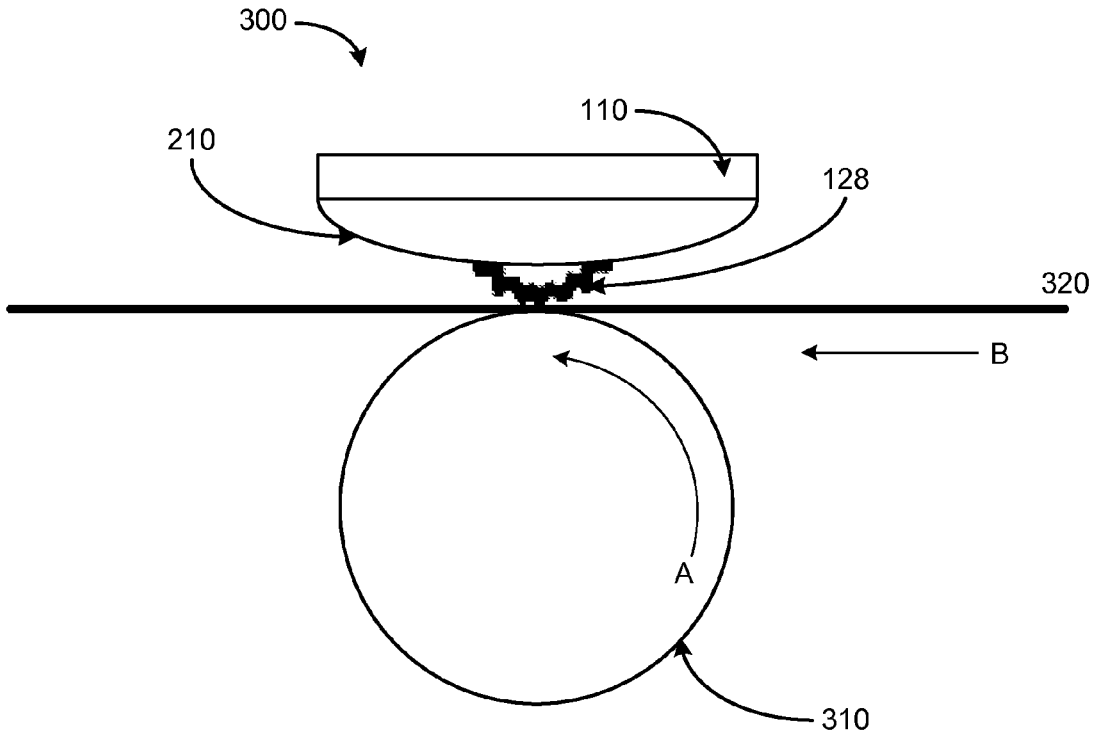
FIG. 3 illustrates an example of a media handling device receiving a media sheet during a print operation, under an embodiment.

FIG. 3 illustrates a side view of an example of a media handling device receiving a media sheet during a print operation, under an embodiment. The media handling device 300 can be similar to the media handling device as described in FIGS. 1A-1C, 2, 4A-4B and 5. References made to elements of FIGS. 1A-1C, 2, 4A-4B and 5 are for purposes of illustrating a suitable element or component being described. Other components of the printer are not illustrated for simplicity purposes.

In FIG. 3, a media handling device 300 is positioned within a printer so that the starwheels 128 (only one starwheel is illustrated for the side view) are adjacent to a roller device 310. The roller device 310 can include or be coupled to a drive shaft and/or motor, so that the printer can cause it to rotate during a print operation (e.g., to push or pull media). In the example provided, a media sheet 320 is being moved in a leftward direction through the printer during a print operation. The configuration of the media handling device 300 and the roller 310 as illustrated in FIG. 3 can be provided within the printer near the input tray (e.g., the roller 310 can cause the media sheet 310 to be moved to the print area with the ink cartridges) or can be provided near the output tray (e.g., the roller 310 can cause the media sheet 310 to be moved after ink is applied to the media sheet 320).

The media sheet 320 (e.g., a sheet of paper, a note card, an envelope, etc.) is pinched by the rotating roller 310 and the media handling device 300. During the print operation, the starwheels 128 of the media handling device 300 can apply a force on the media sheet 320. This pinch force is sufficient to help move the media sheet 320 through the media route without puncturing or damaging the media sheet 320 as the roller 310 moves the media sheet 320 leftward. For example, as the roller 310 rotates in the A direction, the media sheet 320 can move in the B direction. Concurrently, the starwheels 128 of the media handling device 300 can apply the pinching force on the media sheet 320 to assist in the movement of the media sheet 320 and to guide the media sheet 320 in the printer in the B direction.

According to some embodiments, because each carrier structure 122 is coupled to a spring to be under bias to return to an original position, a single starwheel 128 can pinch (against a roller, for example) a media sheet with an amount of 35 grams of pinch force without damaging or puncturing the media sheet 320. By distributing a plurality of starwheels 128 (e.g., such as illustrated in FIG. 1A) along the media handling device 300, a sufficient amount of pinch force can be applied to various types of media. In addition, the starwheels 128 can be provided near the middle of the carrier structure 128, which can increase the normal force relative to the spring. As a result, sufficient pinching force can be provided to a media sheet no matter the type of media or the thickness of the media. For example, some media (e.g., a note card or an envelope or a business card) may be thicker than other media (e.g., a photo paper, legal paper), but due to the springs found in each assembly of the media handling device 300, the media handling device 300 can help move the media within the printer (e.g., a thicker media sheet can cause the assemblies to move or pivot more inward toward the base structure than a thinner media sheet).

Figure 4A:
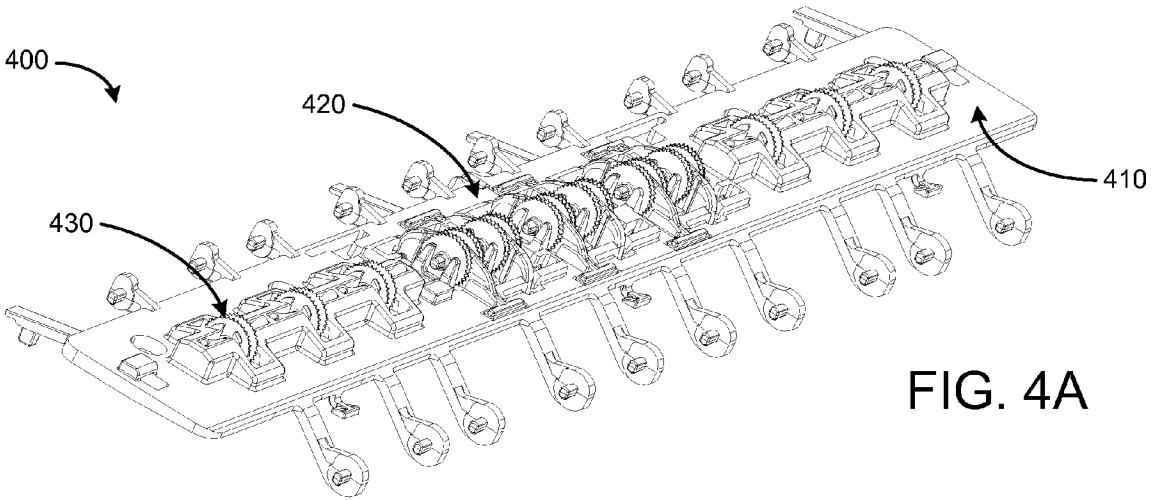
FIGS. 4A-4B illustrate an example media handling device for a printer, according to another embodiment.
Figure 4B:
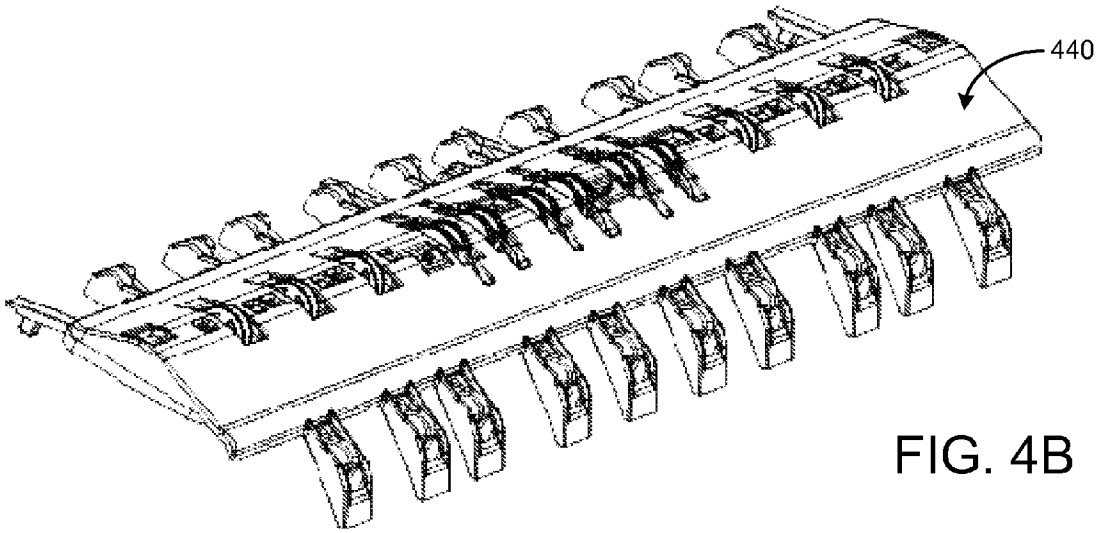

FIGS. 4A-4B illustrate an example media handling device for a printer, according to another embodiment. A media handling device 400 can be similar to the media handling device as described in FIGS. 1A-3. The media handling device 400 can include a base structure 410, and one or more assemblies 420. The media handling device 400 can also include an upper layer structure 430.

In some embodiments, the base structure 410 of the media handling device 400 can have a different shape and/or size than the base structure of FIGS. 1A-1B. Depending on the region or part of the printer in which the media handling device 400 is positioned, the base structure 410 can include different angled surfaces, different engaging/retaining features, different grooves/slots, and/or different raised features. In other embodiments, the media handling device 400 can also include a different group or arrangement of additional assemblies 430 that are provided adjacent to or near the plurality of assemblies 420. In the example illustrated in FIG. 4A, the media handling device 400 can include six assemblies 420 as well as six different assemblies 430 provided on the same base structure 410.

Figure 5:
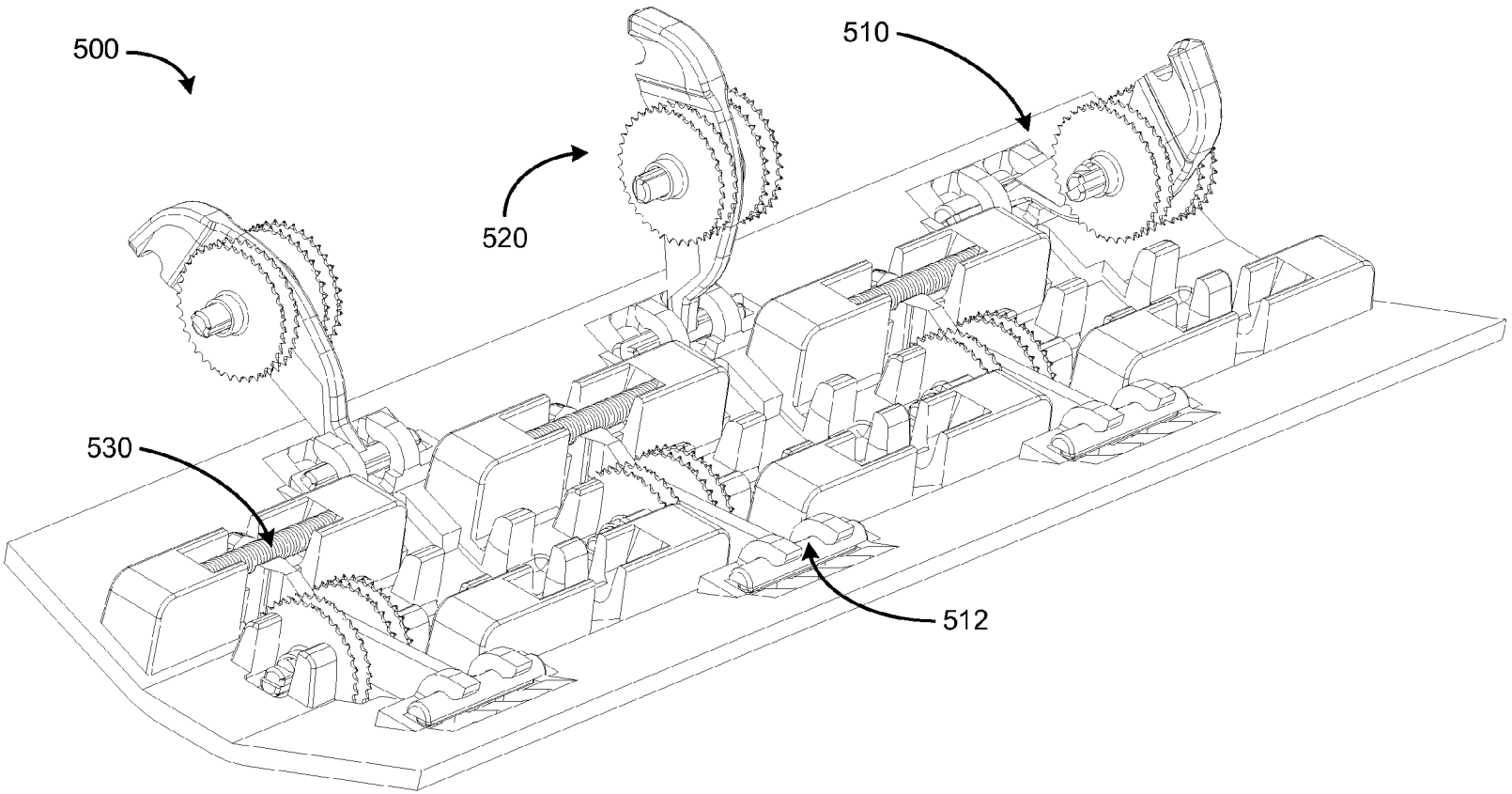
FIG. 5 illustrates an example media handling device for a printer, under an embodiment.

FIG. 5 illustrates an example media handling device for a printer, under another embodiment. A media handling device 500 can be similar to the media handling device as described in FIGS. 1A-4B. The media handling device 500 includes a holder structure 510 in which the plurality of assemblies 520 are provided with. The holder structure 510 is a single piece structure to hold or engage with the assemblies 520 (in place of a base structure and an upper layer structure as illustrated in the previous figures).

The example illustrated in FIG. 5 shows six assemblies 520, where three of the assemblies 520 are not yet fully engaged with the holder structure 510. These three assemblies 520 can be rotated into place, and then engaged with a respective spring 530. The other three assemblies 520 are already engaged with the holder structure 510, with a first end of each carrier structure being engaged at a pivot point 512 of the holder structure 510 and the second end of each carrier structure being engaged with a spring 530.

It is contemplated for embodiments described herein to extend to individual elements and concepts described herein, independently of other concepts, ideas or system, as well as for embodiments to include combinations of elements recited anywhere in this application. Although embodiments are described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mentioned of the particular feature. Thus, the absence of describing combinations should not preclude the inventor from claiming rights to such combinations

What is claimed is:

1. A media handling device for a printer comprising:

a base structure including a slot; and a first assembly engaged with the base structure, the first assembly comprising:

a carrier structure having a first end that is coupled to a pivot point of the base structure, a second end that is engaged to the base structure, and a middle region between the first end and the second end, the carrier structure being capable of partially moving inwards from an original position and being biased to return to the original position, the carrier structure including a pin in the middle region that extends perpendicularly out from a side of the carrier structure; and a starwheel engaged with the pin of the carrier structure to rotate while contacting a media sheet during a print operation, the starwheel being positioned within the slot of the base structure;

wherein the carrier structure includes a second pin in the middle region that extends perpendicularly out from another side of the carrier structure, wherein the first assembly includes one or more additional starwheels engaged with the pin or the second pin, and wherein an equal number of starwheels are provided on each side of the carrier structure.

2. The media handling device of claim 1, wherein the carrier structure is biased to return to the original position by being engaged to a spring coupled to the base structure, and wherein the second end of the carrier structure is engaged to the spring.

3. The media handling device of claim 2, further comprising:

one or more additional assemblies engaged with the base structure, each of the one or more additional assemblies including a carrier structure and a starwheel similar to the first assembly;

wherein the base structure includes one or more additional slots, and wherein the starwheel of each of the one or more additional assemblies is positioned within a corresponding one or more additional slots of the base structure.

4. The media handling device of claim 3, wherein the first assembly and the one or more additional assemblies are aligned with each other on the base structure so that the starwheel of the first assembly is substantially aligned with the starwheel of each of the one or more additional assemblies.

5. The media handling device of claim 1, further comprising:

an upper layer structure including a slot, the upper layer structure being overlaid on the base structure, and wherein a portion of the first assembly protrudes through the slot of the upper layer structure.

6. A printer having an operational state for performing a print operation, the printer comprising:

a media handling device comprising:

a base structure including a slot; and a first assembly engaged with the base structure, the first assembly comprising:

a carrier structure having a first end that is coupled to a pivot point of the base structure, a second end that is engaged to the base structure, and a middle region between the first end and the second end, the carrier structure being capable of partially moving inwards from an original position and being biased to return to the original position, the carrier structure including a pin in the middle region that extends perpendicularly out from a side of the carrier structure;

a starwheel engaged with the pin of the carrier structure to rotate while contacting a media sheet during the print operation, the starwheel being positioned within the slot of the base structure; and an upper layer structure including a slot, the upper layer structure being overlaid on the base structure, wherein a portion of the first assembly protrudes through the slot of the upper layer structure.

7. The printer of claim 6, wherein the carrier structure includes a second pin in the middle region that extends perpendicularly out from another side of the carrier structure, wherein the first assembly includes one or more additional starwheels engaged with the pin or the second pin, and wherein an equal number of starwheels are provided on each side of the carrier structure.

8. The printer of claim 6, wherein the carrier structure is biased to return to the original position by being engaged to a spring coupled to the base structure, and wherein the second end of the carrier structure is engaged to the spring.

9. The printer of claim 8, wherein the media handling device further comprises one or more additional assemblies engaged with the base structure, each of the one or more additional assemblies including a carrier structure and a starwheel similar to the first assembly, wherein the base structure includes one or more additional slots, and wherein the starwheel of each of the one or more additional assemblies is positioned within a corresponding one or more additional slots of the base structure.

10. The printer of claim 9, wherein the first assembly and the one or more additional assemblies are aligned with each other on the base structure so that the starwheel of the first assembly is substantially aligned with the starwheel of each of the one or more additional assemblies.

11. A media handling device comprising:

a base structure including a plurality of slots; and a plurality of assemblies engaged with the base structure, each of the plurality of assemblies comprising:

a carrier structure having a first end that is coupled to the base structure, a second end that is engaged to the base structure, and a middle region between the first end and the second end, the carrier structure being capable of partially moving inwards from an original position and being biased to return to the original position, the carrier structure including a pair of pins in the middle region that each extends perpendicularly out from opposite sides of the carrier structure; and a set of starwheels engaged with the pair of pins of the carrier structure to rotate while contacting a media sheet during a print operation, the set of starwheels being positioned within a corresponding slot of the plurality of slots of the base structure.

12. The media handling device of claim 11, wherein, for each of the plurality of assemblies, an equal number of starwheels are provided on the opposite sides of the carrier structure.

13. The media handling device of claim 11, wherein the plurality of assemblies are arranged in an inverted pattern on the base structure so that (i) the set of starwheels of each of the plurality of assemblies are substantially aligned with each other, and (ii) a first end of a carrier structure for a first assembly is substantially aligned with a second end of a carrier structure for an adjacent assembly.

14. The media handling device of claim 11, wherein, for each of the plurality of assemblies, the carrier structure is biased to return to the original position by being engaged to a spring coupled to the base structure, the second end of the carrier structure being engaged to the spring.

15. The media handling device of claim 11, wherein each spring that is coupled to the base structure and engaged with each of the plurality of assemblies is an axle spring that is positioned with a respective groove of the base structure.

16. The media handling device of claim 11, wherein, for each of the plurality of assemblies, a starwheel in the set of starwheels can rotate independently from the other starwheels in the set of starwheels.

17. The media handling device of claim 11, further comprising:

an upper layer structure including a plurality of slots, the upper layer structure being overlaid on the base structure, and wherein a portion of each of the plurality of assemblies protrudes through the plurality of slots of the upper layer structure.

18. The media handling device of claim 17, wherein the upper layer structure engages with the base structure, and is partially curved in shape.

* * * * *